US007131723B2

(12) United States Patent
Hoshino

(10) Patent No.: US 7,131,723 B2
(45) Date of Patent: Nov. 7, 2006

(54) INK JET RECORDING APPARATUS

(75) Inventor: Yoshihide Hoshino, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 305 days.

(21) Appl. No.: 10/713,582

(22) Filed: Nov. 14, 2003

(65) Prior Publication Data

US 2004/0104989 A1 Jun. 3, 2004

(30) Foreign Application Priority Data

Nov. 20, 2002 (JP) ..... 2002-337040

(51) Int. Cl.
*B41J 2/01* (2006.01)

(52) U.S. Cl. ..... 347/102; 347/17

(58) Field of Classification Search ..... 347/102
See application file for complete search history.

(56) References Cited

U.S. PATENT DOCUMENTS

2001/0052920 A1* 12/2001 Matsumoto et al. ..... 347/102

2003/0035037 A1* 2/2003 Mills et al. ..... 347/102

* cited by examiner

*Primary Examiner*—Stephen Meier
*Assistant Examiner*—Ly T. Tran
(74) *Attorney, Agent, or Firm*—Cantor Colburn LLP

(57) ABSTRACT

An ink jet recording apparatus having: a serial type recording head which has a plurality of ink jet openings for jetting photo-curable ink toward a recording medium, the ink jet openings being arranged in one or more lines; and an irradiation section which is provided adjacent to the recording head in a scanning direction of the recording head, for irradiating an ink jetted on the recording medium with light, the irradiation section having a plurality of irradiation elements which correspond to the ink jet openings, respectively, and which are arranged in one or more lines in approximately parallel with an arrangement direction of the plurality of ink jet openings, and an irradiation controller for controlling the irradiation elements to light at least an irradiation element which corresponds to an ink jet opening which jetted the ink, in the plurality of irradiation elements.

32 Claims, 5 Drawing Sheets

INK JET RECORDING APPARATUS

BACKGROUND OF THE INVENTION

1. Field of the Invention

The present invention relates to an ink jet recording apparatus and, more particularly, to an ink jet apparatus in which photo-curable ink is used.

2. Description of the Related Art

Recently, as a method to record an image on a recording medium such as a paper, an ink jet recording method in which ink is jetted on a surface of the recording medium and a gravure printing method in which ink which is stored in a concave portion of a plate is copied to the recording medium have been well known. In these methods, the ink jet recording method makes it possible to form an image at low cost and easily in comparison with the gravure printing method which requires making a plate. As the ink jet recording method, there is a photo-curable ink jet method in which photo-curable ink is used. An ink jet recording apparatus of the ink jet method has a recording head 101 which has a plurality of ink jet openings 100, . . . for jetting ink toward the recording medium downward and an irradiation section 102 for irradiating ink jetted on a surface of the recording medium with light (see, for example, Japanese Application Patent Laid-Open Publication No. 2001-310454).

More particularly, the irradiation section 102 has one irradiation element 103 such as a mercury lamp which can diffuse light to irradiate a wide region with light for curing the whole ink jetted on the surface of the recording medium.

However, when curing the ink on the surface of the recording medium by the above described irradiation section 102, the irradiation element 103 irradiates a portion of the recording medium on which the ink is not jetted with light. Thus, there has a problem that it requires a large amount of power and the irradiation section 102 has a short life.

One irradiation element 103 diffuses light to irradiate a wide region with light, so that the light radiated from the irradiation section 103 becomes a reflected light with low lighting intensity on the surface of the recording medium and diffuses around. Therefore, specially, when using ink such as cationic polymerization ink which is cured by light with low lighting intensity, the ink which adhered to ink jet openings 100 is cured by the above described reflected light with low lighting intensity and obstructs ink jet.

SUMMARY OF THE INVENTION

An object of the present invention is to provide an ink jet recording apparatus which need little electricity to work and has a long life.

In the first aspect of the invention, the ink jet recording apparatus comprises:

a serial type recording head which has a plurality of ink jet openings for jetting photo-curable ink toward a recording medium, the ink jet openings being arranged in one or more lines; and an irradiation section which is provided adjacent to the recording head in a scanning direction of the recording head, for irradiating an ink jetted on the recording medium with light, the irradiation section having a plurality of irradiation elements which correspond to the ink jet openings, respectively, and which are arranged in one or more lines in approximately parallel with an arrangement direction of the plurality of ink jet openings, and an irradiation controller for controlling the irradiation elements to light at least an irradiation element which corresponds to an ink jet opening which jetted the ink, in the plurality of irradiation elements.

In the second aspect of the invention, the ink jet recording apparatus comprises:

a line type recording head which has a plurality of ink jet openings for jetting photo-curable ink toward a recording medium, the ink jet openings being arranged in one or more lines; and an irradiation section which is provided adjacent to the recording head in a carrying direction of the recording medium, for irradiating an ink jetted on the recording medium with light, the irradiation section having a plurality of irradiation elements which correspond to the ink jet openings, respectively, and which are arranged in one or more lines in approximately parallel with an arrangement direction of the plurality of ink jet openings, and an irradiation controller for controlling the irradiation elements to light at least an irradiation element which corresponds to an ink jet opening which jetted the ink, in the plurality of irradiation elements.

An irradiation element may be provided corresponding to an ink jet opening or the plurality of ink jet openings, or the plurality of irradiation elements may be provided corresponding to an ink jet opening or the plurality of ink jet openings.

According to the ink jet recording apparatus of the present invention, because the irradiation controller controls the irradiation elements to light at least the irradiation elements which correspond to the ink jet openings which jetted the ink, the irradiation elements which are not needed to irradiate the ink do not light. Thus, the irradiation with the light which is not radiated to the ink, that is, the light which does not effect the ink curing can be suppressed, and the irradiation section can have a long life and power consumption can be reduced in comparison with the earlier development.

The amount of reflected light from the recording medium to the ink jet openings can be reduced by suppressing the irradiation with the light which does not effect the ink curing, so that even when using the ink which is cured by light with low lighting intensity, it can be prevented that the ink which adhered to the ink jet openings is cured by receiving the reflected light from the recording medium. Accordingly, the ink does not clog the ink jet openings, and the ink can certainly be jetted on the surface of the recording medium to record an image or the like.

Preferably, the ink jet recording apparatus further comprises an ink jet controller for controlling an amount of the ink jetted from the ink jet opening, the irradiation controller changing an amount of irradiating light to the recording medium from the irradiation element which corresponds to the ink jet opening depending upon an amount of the ink jetted by the ink jet opening.

Accordingly, since the amount of irradiating light to the recording medium changes depending upon the amount of the ink jetted by the ink jet opening, in the ink jet recording method for carrying out recording on the recording medium while changing the tone according to the amount of the ink to be jetted, the irradiation with excess light which does not effect the ink curing can be suppressed. Therefore, the irradiation section can have a longer life and power consumption can be reduced more.

Since the lighting intensity of reflected light from the recording medium to the ink jet openings can be reduced by suppressing the irradiation with excess light which does not effect the ink curing, it can be prevented that the ink which adhered to the ink jet openings is cured by receiving the reflected light from the recording medium. Accordingly, the ink can certainly be jetted on the surface of the recording medium to record an image.

Preferably, the irradiation element is provided as many as the ink jet opening.

Accordingly, since the irradiation elements can be provided corresponding to the ink jet openings, respectively, the irradiation with the light which does not effect the ink curing can be suppressed and the ink jetted from each ink jet opening and jetted on the recording medium can certainly be irradiated with light.

The number of the irradiation elements may be less than the number of the ink jet openings, an irradiation element may be provided corresponding to an ink jet opening group which comprises at least an ink jet opening, and the irradiation controller may change an amount of irradiating light to the recording medium from the irradiation element which corresponds to the ink jet opening group depending upon an amount of the ink jetted from the ink jet opening group.

Accordingly, the number of the irradiation elements is less than the number of the ink jet openings, so that the structure of the irradiation section can be simplified in comparison with the case of providing the irradiation elements as many as the ink jet openings.

The amount of the irradiating light to the recording medium from the irradiation elements corresponding to the jet opening groups changes depending upon the amount of the ink jetted from the jet opening groups, so that the ink jetted on the recording medium can certainly be cured.

The irradiation element may comprise one end of an optical cable, another end of which being connected to a light source.

Accordingly, the irradiation element has a simple structure, so that the plurality of irradiation elements can be easily disposed in line in comparison with the case of disposing a light source such as a mercury lamp in line.

The optical cable has a function as a light waveguide. The publicly known optical cable such as an optical fiber can be used.

The light source which is connected to the optical cable may be provided outside of the irradiation section. In this case, the irradiation section can be lightweight in comparison with the case of providing the light source inside of the irradiation section. Further, since the irradiation section can be lightweight as described above, a member for supporting the irradiation section can be simplified. Accordingly, the ink jet recording apparatus can be made at low cost.

Preferably, the irradiation element irradiates the ink jetted on the recording medium with light as an approximately parallel pencil.

Accordingly, since the ink jetted on the recording medium is irradiated with approximately parallel pencil, the light reflected from the recording medium is unlikely to diffuse in comparison with diffuse light. Therefore, it can certainly be prevented that the ink which adhered to the ink jet openings is cured by receiving the reflected light from the recording medium, because the light radiated from the irradiation section and reflected from the surface of recording medium is prevented from reaching the ink jet openings. Thus, the ink does not clog the ink jet openings and can certainly be jetted on the surface of the recording medium to record an image. Preferably, the irradiation element which radiates an approximately parallel pencil is a light emitting diode or a semiconductor laser.

The irradiation element may irradiate the ink jetted on the recording medium with light as one of a convergent light or a diffuse light.

Preferably, the irradiation section further comprises a lens for approximately equalizing a size of an irradiated portion of the recording medium with a size of a dot formed by the ink on the recording medium by refracting light radiated from the irradiation element.

Accordingly, since the size of the irradiated portion of the recording medium and the size of the dot formed by the ink on the recording medium are approximately equal, the irradiation with the light radiated outside the dot and does not effect the ink curing can certainly be suppressed, and the ink is efficiently cured. Thus, the irradiation section can have a longer life and power consumption can be reduced more.

Since the amount of reflected light from the recording medium to the ink jet openings can be reduced by suppressing the irradiation with the light radiated outside the dot and does not effect the ink curing, it can be prevented more certainly that the ink which adhered to the ink jet openings is cured by receiving the reflected light from the recording medium. Thus, the ink can certainly be jetted on the surface of the recording medium to record an image.

The irradiation section may further comprise a lens for approximately equalizing a size of an irradiated portion of the recording medium with a size of an ink jetted region of the ink jetted from the jet opening group.

Accordingly, since the size of the irradiated portion of the recording medium and the size of the ink jetted region of the ink jetted from the jet opening group are approximately equal, the irradiation with the light radiated outside the ink jetted region and does not effect the ink curing can certainly be suppressed, and the ink is efficiently cured. Accordingly, the irradiation section can have a longer life and power consumption can be reduced more.

Since the amount of reflected light from the recording medium to the ink jet openings can be reduced by suppressing the irradiation with the light radiated outside the ink jetted region and does not effect the ink curing, it can be prevented more certainly that the ink which adhered to the ink jet openings is cured by receiving the reflected light from the recording medium. Thus, the ink can certainly be jetted on the surface of the recording medium to record an image or the like.

Preferably, the irradiation section further comprises a lens for approximately equalizing a diameter of an irradiated portion of the recording medium in the arrangement direction with a dot diameter formed by the ink on the recording medium by refracting light radiated from the irradiation element.

Accordingly, since the diameter of the irradiated portion of the recording medium in the arrangement direction and the dot diameter formed by the ink on the recording medium are approximately equal, the irradiation with the light radiated outside the dot and does not effect the ink curing can certainly be suppressed, and the ink is efficiently cured. Thus, the irradiation section can have a longer life and power consumption can be reduced more.

Since the amount of reflected light from the recording medium to the ink jet openings can be reduced by suppressing the irradiation with the light radiated outside the dot and does not effect the ink curing, it can be prevented more certainly that the ink which adhered to the ink jet openings is cured by receiving the reflected light from the recording medium. Thus, the ink can be jetted more certainly on the surface of the recording medium to record an image.

A diameter of the irradiated portion of the recording medium in a direction other than the arrangement direction may be larger than the dot diameter. In this case, the irradiation time to the ink on the recording medium during the recording head scanning can be long in the ink jet printer having the serial type recording head, and the irradiation time to the ink on the recording medium during carrying the recording medium can be long in the ink jet printer having the line type recording head. Accordingly, the ink on the recording medium can certainly be cured.

The irradiation section may further comprise a lens for approximately equalizing a diameter of an irradiated portion of the recording medium in the arrangement direction with a size of an ink jetted region of the ink jetted from the jet opening group in the arrangement direction by refracting light radiated from the irradiation element.

Accordingly, since the diameter of the irradiated portion of the recording medium in the arrangement direction and the size of the ink jetted region of the ink jetted from the jet opening group in the arrangement direction are approximately equal, the irradiation with the light radiated outside the ink jetted region and does not effect ink curing can certainly be suppressed more certainly, and the ink is efficiently cured. Accordingly, the irradiation section can have a longer life and power consumption can be reduced more.

Since the amount of reflected light from the recording medium to the ink jet openings can be reduced by suppressing the irradiation with the light radiated outside the ink jetted region and does not effect the ink curing, it can be prevented more certainly that the ink which adhered to the ink jet openings is cured by receiving the reflected light from the recording medium. Thus, the ink can be jetted more certainly on the surface of the recording medium to record an image.

A diameter of the irradiated portion of the recording medium in a direction other than the arrangement direction may be larger than the size of the ink jetted region in the arrangement direction. In this case, the irradiation time to the ink on the recording medium during the recording head scanning can be long in the ink jet printer having the serial type recording head, and the irradiation time to the ink on the recording medium during carrying the recording medium can be long in the ink jet printer having the line type recording head. Accordingly, the ink on the recording medium can certainly be cured.

Preferably, in the ink jet recording apparatus, a plurality of recording heads are provided.

Accordingly, recording can be performed using a plurality color of inks, for example, by jetting the ink with different colors from the plurality of recording heads. In addition, by providing the irradiation section less than the number of the recording heads and making the irradiation elements correspond to the ink jet openings of the plurality of recording heads, power consumption can be reduced in comparison with the case of providing the irradiation section as many as the number of the recording heads.

Preferably, in the ink jet recording apparatus, an image is recorded on the recording medium.

Preferably, the irradiation element is at least any one of a solid-state laser, a gas laser, a liquid laser, a free electron laser, an X-ray laser, a fluorescent tube, a light emitting diode and an electron beam irradiation device.

Preferably, the ink jet opening jets an ultraviolet curable ink, and the irradiation element radiates an ultraviolet-ray.

Preferably, the ink jet opening jets a cationic polymerization ink.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

Hereinafter, the preferred embodiments of the present invention will be described in detail by reference to the attached drawings. In the embodiment, an ink jet recording apparatus will be explained as an ink jet printer. The ink jet printer is an apparatus which records a desired image with photo-curable ink on a recording medium which is sequentially carried.

[First Embodiment]

Figure 1:
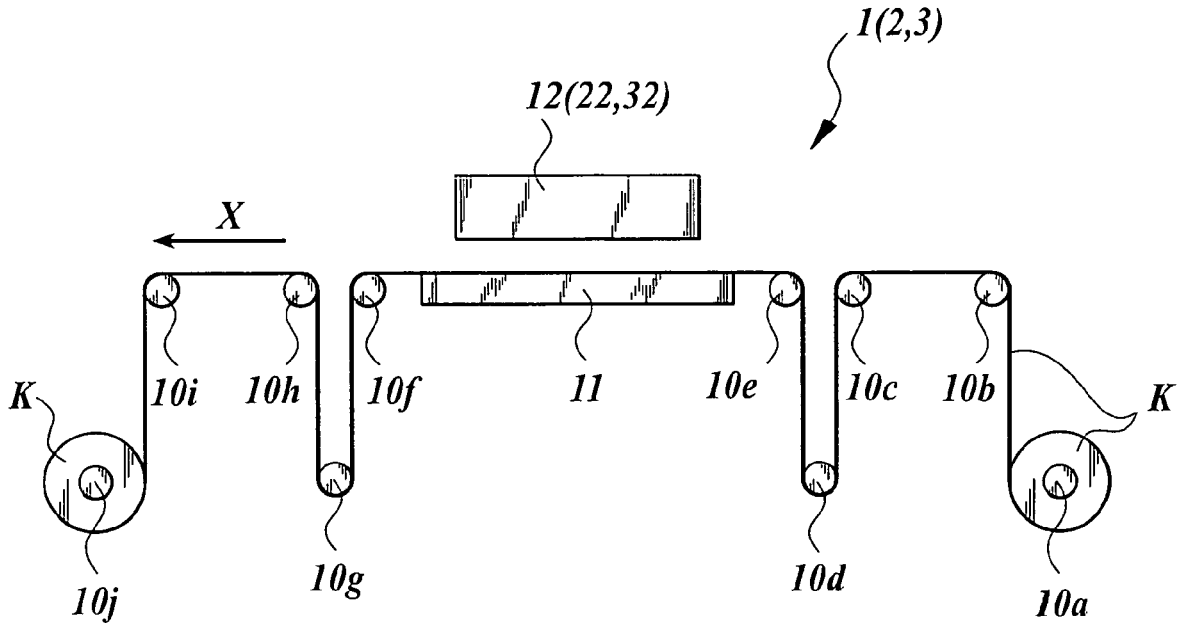
FIG. 1 is a side view showing a schematic configuration of the first embodiment of an ink jet recording apparatus according to the present invention.

The ink jet printer 1, as shown in FIG. 1, comprises a platen 11 for supporting a recording medium K which is carried in a carrying direction (arrangement direction) X on an upper portion and an image recording device 12 for recording an image on the recording medium K which is supported by the platen 11.

The platen 11 has an approximately flat upper surface, and is provided with a suction mechanism (not shown) for making the recording medium K closely contact with the upper surface thereof. The suction mechanism comprises a plurality of suction openings which are provided on the upper surface of the platen 11 and a suction chamber which has a fan. The suction chamber is provided in a state of being connected to the suction openings. The fan is driven to suction the recording medium K through the plurality of suction openings, and the recording medium K is held on the upper surface of the platen 11.

On the upstream side of the platen 11 in the carrying direction X, a feed roller 10*a* on which the long recording medium K with a predetermined width is wound is rotatably disposed. On the downstream side of the platen 11 in the carrying direction X, a winding roller 10*j* for winding the recording medium K which is carried from the feed roller 10*a* is disposed. The winding roller 10*j* is rotatably driven by a driving source such as a motor (not shown). The driving source rotates the winding roller 10*j* intermittently so as to carry the recording medium K in the carrying direction X.

Four driven rollers 10*b*–10*e* for leading the recording medium K from the feed roller 10*a* are rotatably disposed between the feed roller 10*a* and the platen 11. In the driven rollers 10*b*–10*e*, the first, second and fourth driven rollers 10*b*, 10*c*, 10*e* which are disposed toward a downstream side in the carrying direction X from the feed roller 10*a* support the recording medium K at a level approximately equal to the level of the platen 11. The third driven roller 10*d* leads the recording medium K downward to give a constant tension thereto.

Four driven rollers 10*f*–10*i* for leading the recording medium K are also rotatably disposed between the platen 11 and the winding roller 10*j*. In the driven rollers 10*f*–10*i*, the first, third and fourth driven rollers 10*f*, 10*h*, 10*i* which are disposed toward a downstream side in the carrying direction X from the platen 11 support the recording medium K at a level approximately equal to the level of the platen 11. The second driven roller 10*g* leads the recording medium K downward to give a constant tension thereto.

Figure 2:
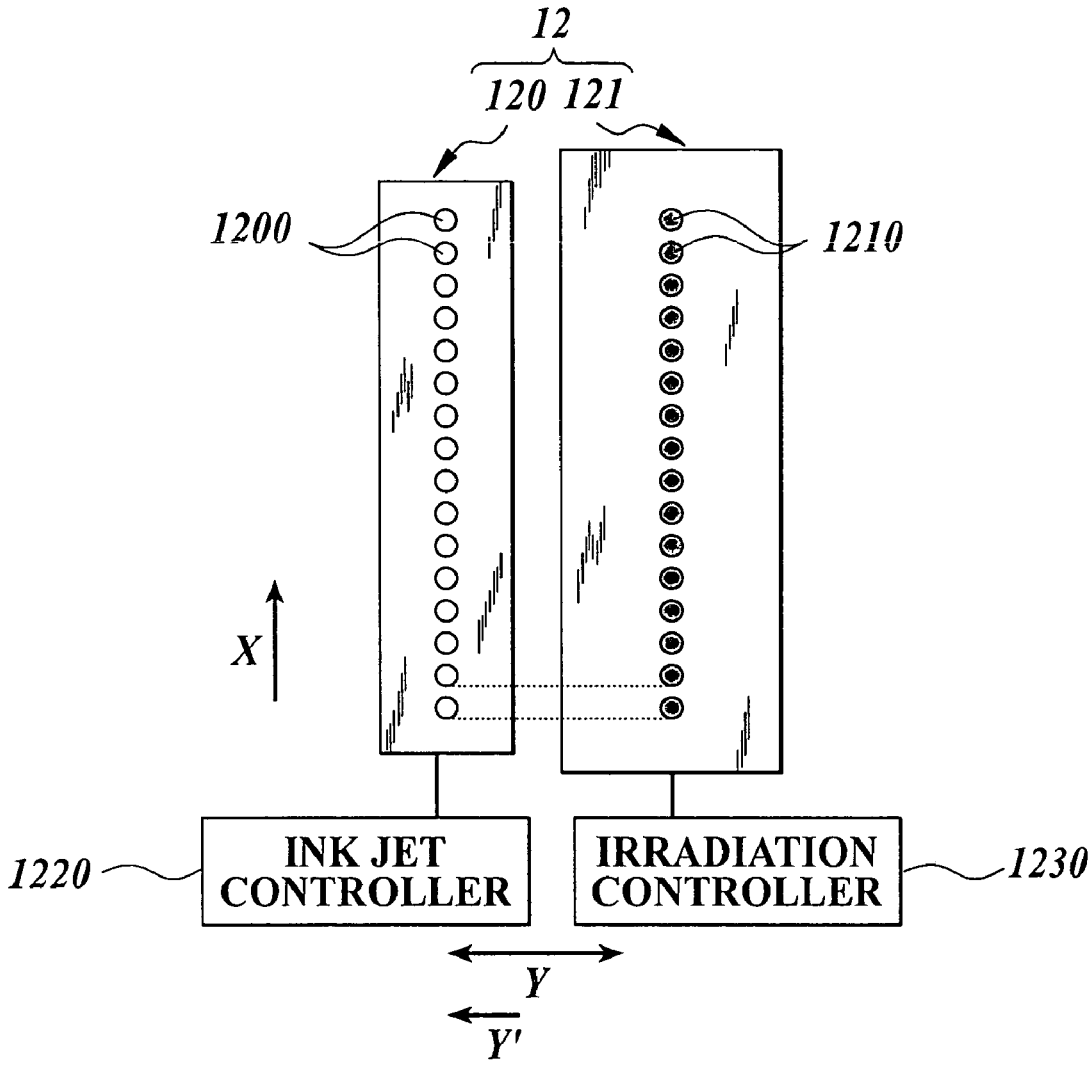
FIG. 2 is a bottom view of a recording head and an irradiation section in the first embodiment.

The image recording device 12, as shown in FIG. 2, comprises a recording head 120 for jetting the photo-curable ink and an irradiation section 121 for radiating light, and is mounted on a carriage (not shown) which is provided to be allowed to reciprocally scan in a scanning direction Y.

Thus, the recording head 120 and the irradiation section 121 are relatively movable in the scanning direction Y relative to the recording medium K. The scanning direction Y in the embodiment is a direction which is perpendicular to the carrying direction X, that is, a width direction of the recording medium K.

The recording head 120 is a serial type recording head which follows the reciprocating movement of the carriage. On the lower surface of the recording head 120, a plurality of hyperfine ink jet openings 1200, . . . are arranged in the carrying direction X. In the following explanation, the recording head 120 comprises N (N is a natural number) ink jet openings 1200 for convenience' sake. The ink jet openings 1200, . . . jet the ink as hyperfine droplets toward the recording medium K when moving in one direction (hereinafter referred to as an image forming direction Y') of the scanning direction Y following the carriage. The recording head 120 is provided with an ink jet controller 1220 for controlling an amount of the ink to be jetted from each ink jet opening 1200.

The irradiation section 121 is disposed on the opposite side of the recording head 120 with respect to the image forming direction Y', and comprises a plurality of irradiation elements 1210, . . . for radiating light and an irradiation controller 1230 for controlling each irradiation element 1210.

The irradiation element 1210 is a semiconductor laser which radiates ultraviolet-rays (UV-rays). The irradiation elements 1210, . . . are provided as many as the ink jet openings 1200, . . . , that is, N irradiation elements 1210 are provided. The irradiation elements 1210, . . . are arranged in the carrying direction X. Each of the plurality of irradiation elements 1210, . . . correspond to one of the ink jet openings 1200, . . . . Specifically, the n-th ("n" is a natural number, $1 \leqq n \leqq N$) irradiation element 1210 from the upstream side to the downstream side in the carrying direction X corresponds to the n-th ink jet opening 1200 from the upstream side to the downstream side in the carrying direction X. The ink jet opening 1200 and the irradiation element 1210 which correspond each other are positioned in the scanning direction Y.

In FIG. 2, the correspondence relation between the irradiation element 1210 and the ink jet opening 1200 is shown in a broken line.

Figure 3:
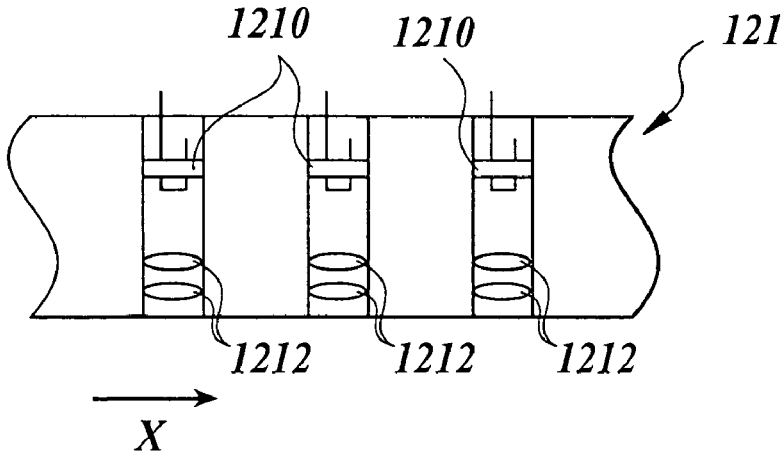
FIG. 3 is a side view of the irradiation section in the first embodiment.

As shown in FIG. 3, two lenses 1212, 1212 are disposed on a lower portion of each of the irradiation elements 1210. The lenses 1212, 1212 refract the light radiated from the irradiation elements 1210 to be parallel pencil, and equalize the size of an irradiated portion of the recording medium K with the size of a dot formed by the ink jetted on the recording medium K.

The irradiation controller 1230 controls each of the irradiation element 1210 to light at least the irradiation elements 1210 which correspond to the ink jet openings 1200 which jetted the ink, in the plurality of irradiation elements 1210, . . . . In the embodiment, the irradiation controller 1230 controls each of the irradiation elements 1210 to light only the irradiation elements 1210 which correspond to the ink jet openings 1200 which jetted ink. The irradiation controller 1230 is adapted to be able to change an amount of the irradiating light to the recording medium K from the irradiation element 1210 corresponding to the ink jet opening 1200, depending upon an amount of the ink jetted from the ink jet opening 1200.

The carriage is provided with a guide member (not shown) for guiding the carriage movement and a driving section (omitted from the drawings) for moving the carriage. The guide member is a rod like member which extends in the scanning direction Y. The driving section is adapted to make the carriage reciprocally move in the scanning direction Y when the carrying of the recording medium K in the carrying direction X is stopped.

The ink which is used in the embodiment will be explained.

As the ink used in the embodiment, specially, the ink which is adapted in "Curing System Utilizing Photo-Acid and Base Generating Agent (Section 1)" or "Photo-induced Alternating Copolymerization (Section 2)" of "Photo-Curing System (Chapter 4)" in "Photo-Curing Technique—Selection and Compounding Condition of Resin and Initiator, and Measurement and Assessment of Curing Degree (Technical Association Information)" can be applied. The ink which is cured by radical polymerization may be used.

Specifically, the ink which is used in the embodiment is UV curable ink having a property of being cured by the irradiation with UV-rays as light. As the main component of the ink, at least polymerizing compound (publicly known polymerizing compounds are included.), photo initiator and colorant are included. However, when the ink which is adapted to the above described "Photo-Induced Alternating Copolymerization (Section 2)" is used in the embodiment, the photo initiator may be excluded. The above described photo-curable ink is classified into radical polymerization ink containing radical polymerizing compound and cationic polymerization ink containing cationic polymerizing compound, and both of them are adaptable as the ink to be used in the embodiment. Hybrid ink in which the radical polymerization ink and the cationic polymerization ink are combined may be applied.

However, since the cationic polymerization ink with less or no inhibition of polymerization reaction by oxygen has greater functionality and versatility, the cationic polymerization ink is especially used in the embodiment.

Specifically, the cationic polymerization ink which is used in the embodiment is a mixture containing at least cationic polymerizing compound such as oxetane compound, epoxy compound and vinyl ether compound or the like, photo cationic initiator, and colorant. As described above, the ink has a property of being cured by the UV irradiation.

The ink (including the radical polymerization ink, cationic polymerization ink and the hybrid ink.) used in the embodiment is cured by the UV irradiation as described above, however, it is not limited thereto. The ink may be cured by being irradiated with light other than UV-rays. The "light" is a light in a broad sense and includes an electromagnetic wave such as a UV-ray, an electron beam, an X-ray, a visible ray and an infrared ray. That is, in the ink used in the embodiment, polymerizing compound which is polymerized by light other than UV-rays to cure and photo initiator for initiating polymerization reaction between polymerizing compounds by light other than UV-rays may be applied. When the photo-curable ink which is cured by light other than UV-rays is used in the embodiment, a light source which radiates appropriate light should be applied as an irradiation section in the present invention.

The recording medium K used in the embodiment will be explained.

As the recording medium K used in the embodiment, the recording medium which consists of material such as various types of papers such as a plain paper, a recycled paper and a gloss paper, textiles, non-woven fabrics, resin, metal and glass or the like can be applied. As a form of the recording medium K, a roll type, a cut sheet type, a plate type or the like can be applied. In the embodiment, a long resin made film which is wound in a roll state as shown in FIG. 1 is used.

Specially, as the recording medium K used in the embodiment, a non-absorptive resin made film which is transparent or nontransparent and used for so-called soft packing can be applied. As a specific example of resin for the resin made film, polyethylene terephthalate, polyester, polyolefin, polyamide, polyester amide, polyether, polyimide, polyamideimide, polystyrene, polycarbonate, poly-ρ-phenylene sulfide, polyetherester, polyvinyl chloride, poly (meth) acrylic ester, polyethylene, polypropylene, nylon or the like can be applied. Further, copolymer, mixture, or bridge formation of these resins or the like can also be applied. Especially, selecting any one of the polyethylene terephthalate, polystyrene, polypropylene and nylon is preferable as a type of resin for the resin made film when considering transparency, dimensional stability, stiffness, environmental burden, cost or the like. Moreover, it is preferable that the resin made film has a thickness of 2–100 μm (more preferably, 6–50 μm). The surface of the supporter of the resin made film may be pre-treated to enhance adhesion by corona discharge or the like.

Furthermore, as the recording medium K use in the embodiment, publicly known nontransparent recording media such as various types of papers whose surfaces are coated with resin, a film containing pigment, a foam film and the like can also be applied.

An operation of the ink jet printer 1 while recording an image will be explained.

The image recording by the ink jet printer 1 comprises a recording step to jet the ink on the recording medium K and cure the ink, and a carrying step to carry the recording medium K.

In the recording step, the recording medium K is in a state of-being stopped without being carried, and the carriage is scanned together with the recording head 120 and the irradiation section 121 in the image recording direction Y'. When scanning, first, the ink is jetted from the recording head 120 toward the recording medium K in a state of controlling each ink jet opening 1200 by the ink jet controller 1220. Next, the irradiation section 121 irradiates the ink jetted on the recording medium K with light. The irradiation controller 1230 controls to light only the irradiation elements 1210 which correspond to the ink jet openings 1200 which jetted the ink in the plurality of the irradiation elements 1210, . . . . The irradiation controller 1230 also controls to change the amount of the irradiating light to the recording medium K from the irradiation elements 1210 depending upon the amount of the jetted ink.

When the ink jetted from the recording head 120 is jetted on the recording medium K, the carriage intercepts light from the irradiation section 121 and light does not reach the ink on the recording medium K. However, since the irradiation section 121 moves above the ink on the surface of the recording medium K with the scanning of the carriage, the irradiation section 121 irradiates the ink immediately after the ink being jetted on the recording medium K to cure the ink, and the ink is adhered to the recording medium K.

The above described carriage scanning is performed at appropriate times, and the ink jet and the light irradiation are performed.

Next, in the carrying step, the recording medium K is appropriately carried in the carrying direction X.

Subsequently, the above described operations are repeated to print an image on the recording medium K.

According to the ink jet printer 1, the irradiation controller 1230 controls each irradiation element 1210 to light only the irradiation elements 1210 which correspond to the ink jet openings 1200 which jetted ink, so that the irradiation controller 1230 does not light the irradiation elements 1210 which are not needed to irradiate. Thus, the irradiation with the light which is not radiated to the ink on the recording medium K, that is, the light which does not effect the ink curing can be suppressed, so that the irradiation section 121 can have a long life and power consumption can be reduced in comparison with the earlier development.

The amount of reflected light from the recording medium K to the ink jet openings 1200, . . . can be reduced by suppressing the light irradiation which does not effect the ink curing, so that even when using ink such as cationic polymerization ink which is cured by light with low lighting intensity, it can be prevented that the ink which adhered to the ink jet openings 1200, . . . is cured by receiving the reflected light from the recording medium K. Accordingly, the ink does not clog the ink jet openings 1200, and the ink can certainly be jetted on the surface of the recording medium K to record an image.

The amount of the irradiating light to the recording medium K changes depending upon the amount of the ink jetted from the ink jet opening 1200. Thus, when recording is performed on the recording medium K while changing the tone according to the amount of the ink, the irradiation with excess light which does not effect the ink curing can be suppressed. Accordingly, the irradiation section 121 can have a longer life and power consumption can be reduced more.

Since the ink jet openings 1200 and the irradiation elements 1210 which correspond each other are positioned approximately along the scanning direction Y, the light irradiation which does not effect the ink curing can certainly be suppressed, and the ink jetted from each ink jet opening 1200 and jetted on the recording medium K can certainly be irradiated with light.

Since the ink jetted on the recording medium K is irradiated with approximately parallel pencil, the light which reflects from the recording medium K is unlikely to diffuse in comparison with diffuse light. Thus, it can certainly be prevented that the ink which adhered to the ink jet openings 1200 is cured by receiving the reflected light from the recording medium K. Accordingly, the ink does not clog the ink jet openings 1200 and can certainly be jetted on the surface of the recording medium K to record an image.

Since the size of the irradiated portion of the recording medium K and the size of the dot formed by the ink jetted on the recording medium K are equal, the irradiation with the light radiated outside the dot and does not effect the ink curing can certainly be suppressed, and the ink is efficiently cured. Accordingly, the irradiation section 121 can have a longer life and power consumption can be reduced more.

[Second Embodiment]

The second embodiment in the present invention will be explained. The component element that is same as the first embodiment will be given with the same reference numeral and the explanation thereof will be omitted.

The ink jet printer 2 in the second embodiment is different from the ink jet printer 1 in the first embodiment in the point that the configuration of an image recording device 22 differs from that of the image recording device 12. The difference will be explained in detail below.

Figure 4:
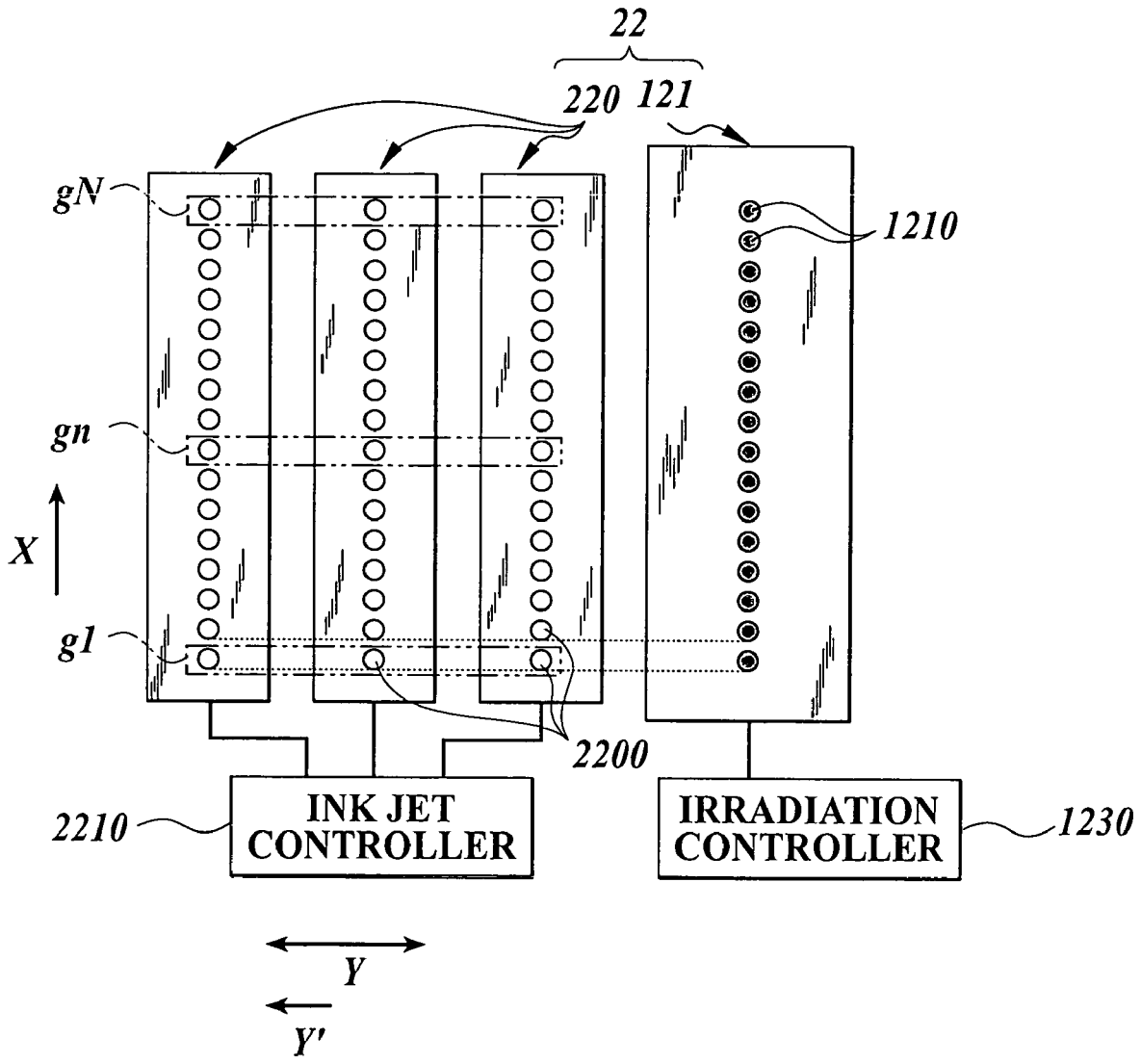
FIG. 4 is a bottom view of the recording head and the irradiation section in the second embodiment.

The image recording device 22 comprises three recording heads 220, . . . and an irradiation section 121 as shown in FIG. 4, and is mounted on a carriage (not shown) which is same as the carriage in the first embodiment.

Each of the three recording heads 220, . . . is for jetting ink of any one of the process colors which consist of yellow, magenta and cyan. The recording heads 220, . . . are serial type recording heads, and jet the ink when moving in the image forming direction Y' following the carriage. The recording heads 220, . . . are disposed in juxtaposition to each other in the scanning direction Y.

On the lower surface of the recording heads 220, . . . , a plurality of hyperfine ink jet openings 2200, . . . are arranged in the carrying direction X. Same number of the ink jet openings 2200, . . . are provided on each recording head 220. In the following explanation, each recording head 220 comprises N ink jet openings 2200 as a matter of convenience.

The plurality of the ink jet openings 2200, . . . which are provided on each recording head 220 form ink jet opening groups (hereinafter referred to jet opening groups) g1–gN with the plurality of ink jet openings 2200, . . . of the other two recording heads 220, 220. That is, the n-th jet opening 2200 in the jet openings 2200, . . . which are provided on each recording head 220 from the upstream side to the downstream side in the carrying direction X forms a jet opening group gn with the two n-th jet openings 2200, 2200 which are provided on the other two recording heads 220, 220. The ink jet openings 2200, . . . forming the jet opening group gn are positioned along the scanning direction Y.

The recording head 220 is provided with an ink jet controller 2210 for controlling the amount of the ink to be jetted from each ink jet opening 2200.

The irradiation section 121 is disposed on the opposite side of the three recording heads 220 with respect to the image forming direction Y'.

A plurality of the irradiation elements 1210, . . . of the irradiation section 121 are provided as many as the ink jet openings 2200 which are provided on each recording head 220, that is, N irradiation elements 1210 are provided. The irradiation elements 1210 are arranged in the carrying direction X. Each of the plurality of irradiation elements 1210, . . . corresponds to any one of the ink jet opening groups g1–gN. Specifically, the n-th ("n" is a natural number, $1 \leqq n \leqq N$) irradiation element 1210 from the upstream side to the downstream side in the carrying direction X corresponds to the n-th jet opening group gn. The irradiation element 1210 and the jet opening group gn which correspond each other are positioned in the scanning direction Y.

In FIG. 4, the correspondence relation between the irradiation element 1210 and the ink jet opening 2200 is shown in a broken line.

The irradiation controller 1230 controls each irradiation element 1210 to light only the irradiation element which corresponds to the jet opening group gn which jetted the ink in the plurality of the irradiation elements 1210, . . . . The irradiation controller 1230 is adapted to be able to change the amount of the irradiating light to the recording medium K from the irradiation element 1210 corresponding to the jet opening group gn depending upon the amount of the ink jetted from each jet opening group gn.

According to the ink jet printer 2, recording can be performed with a plurality color of inks by jetting the ink with different colors from the three recording heads 220, . . . The number of the irradiation sections 121 is less than the number of the recording heads 220, so that power consumption can be reduced in comparison with the case of providing the irradiation section 121 as many as the number of the recording heads 220.

The amount of the irradiating light to the recording medium K from the irradiation element 1210 corresponding to the jet opening group gn changes depending upon the amount of the ink jetted from the jet opening group gn, so that the ink jetted on the recording medium K can certainly be cured.

[Third Embodiment]

The third embodiment in the present invention will be explained. The component element that is same as the first embodiment will be given with the same reference numeral and the explanation thereof will be omitted.

The ink jet printer 3 in the third embodiment is different from the ink jet printer 1 in the first embodiment in the point that the configuration of an image recording device 32 differs from that of the image recording device 12. The difference will be explained in detail below.

Figure 5:
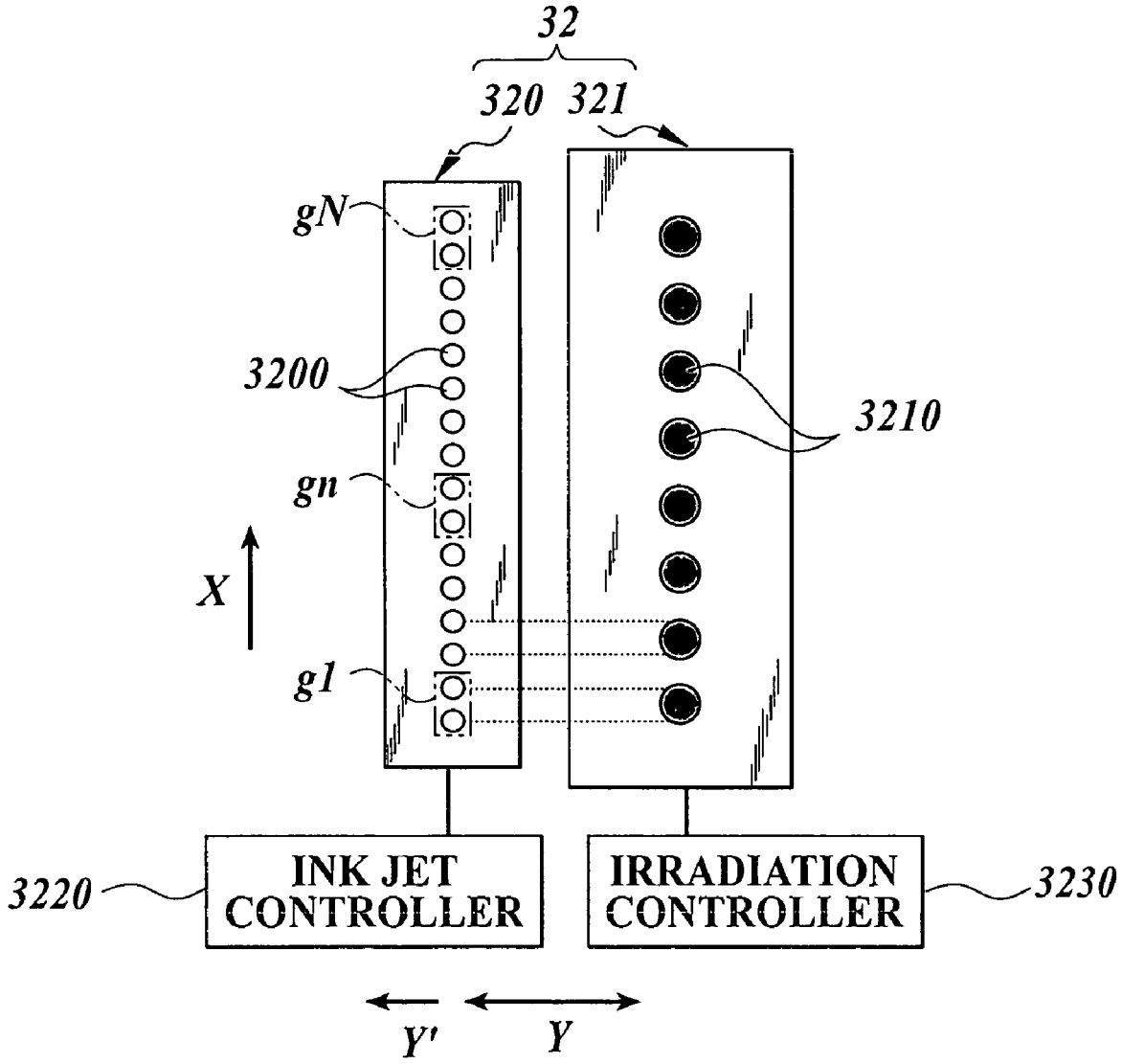
FIG. 5 is a bottom view of the recording head and the irradiation section in the third embodiment.

The image recording device 32 comprises a recording head 320 having a plurality of ink jet openings 3200, . . . and an irradiation section 321 having a plurality of irradiation elements 3210, . . . as shown in FIG. 5, and is mounted on a carriage (not shown) which is same as the carriage in the first embodiment.

The recording head 320 is a serial type recording head, and jets the ink when moving in the image forming direction Y' following the carriage. On the lower surface of the recording head 320, 2N hyperfine ink jet openings 3200, . . . are arranged in the carrying direction X. In the following explanation, the recording head 320 comprises 2N ink jet openings 3200 as a matter of convenience. The 2N ink jet openings 3200, . . . form ink jet opening groups (hereinafter referred to a jet opening group) g1–gN. In more detail, the (2n-1)-th ink jet opening 3200 from the upstream side to the downstream side in the carrying direction X pairs with the 2n-th ink jet opening 3200 which is on the downstream side of the (2n-1)-th ink jet opening 3200 to form a jet opening group gn. The recording head 320 is provided with an ink jet controller 3220 for controlling the amount of the ink to be jetted from each ink jet opening 3200.

The irradiation section 321 is disposed on the opposite side of the recording head 120 with respect to the image forming direction Y'. The irradiation section 321 comprises the plurality of irradiation elements 3210, . . . and an irradiation controller 3230 for controlling each irradiation element 3210.

The plurality of the irradiation elements 3210, . . . are semiconductor lasers which radiate UV-rays, and are arranged in the carrying direction X. The irradiation elements 3210, . . . are provided corresponding to the jet opening groups g1–gN, respectively, and the number of the irradiation elements 3210 is equal to the number of the jet opening groups g1–gN. Each of the plurality of irradiation elements 3210, . . . corresponds to any one of the jet opening groups g1–gN. Specifically, the n-th irradiation element 3210 from the upstream side to the downstream side in the carrying direction X corresponds to the n-th jet opening group gn. The irradiation element 3210 and the jet opening group gn which correspond each other are positioned along the scanning direction Y.

In FIG. 5, the correspondence relation between the irradiation element 3210 and the ink jet opening 3200 is shown in a broken line.

Lenses 1212, 1212 are disposed on a lower portion of each irradiation element 3210. The lens 1212 refracts the light radiated from the irradiation element 3210, and equalizes the size of the irradiated portion of the recording medium K with the size of the ink jetted region of the ink jetted from the jet opening group gn.

The irradiation controller 3230 controls each of the irradiation elements 3210 to light only the irradiation element 3210 which corresponds to the ink jet opening group gn which jetted ink. The irradiation controller 3230 is adapted to be able to change the amount of the irradiating light to the recording medium K from the irradiation element 3210 corresponding to the jet opening group gn, depending upon the amount of the ink jetted by the jet opening group gn.

According to the ink jet printer 3, the number of the irradiation elements 3210 is less than the number of the ink jet openings 3200, so that the structure of the irradiation section 321 can be simplified in comparison with the case of providing the irradiation elements 3210 as many as the ink jet openings 3200.

The amount of the irradiating light to the recording medium K from the irradiation element 3210 corresponding to the jet opening group gn changes depending upon the amount of the ink jetted from the jet opening group gn, so that the ink jetted on the recording medium K can certainly be cured.

Figure 6:
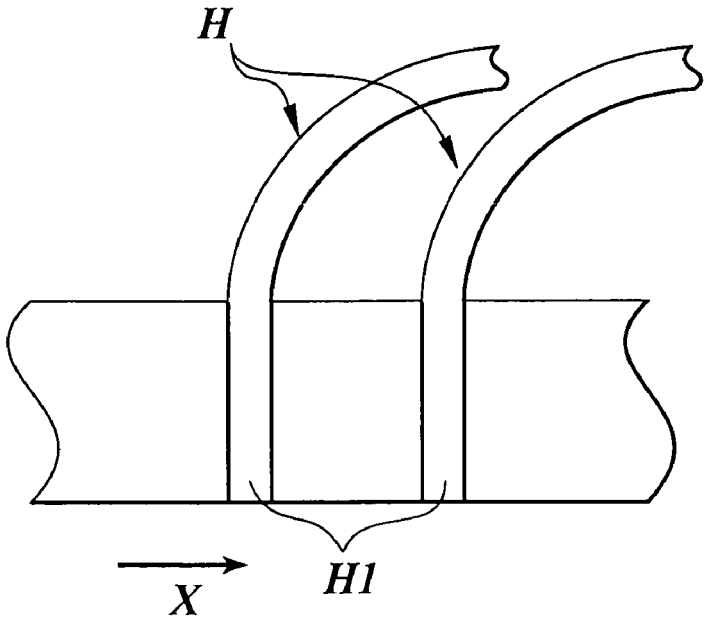
FIG. 6 is a side view of the irradiation section of a modification in the first embodiment.
Figure 7:
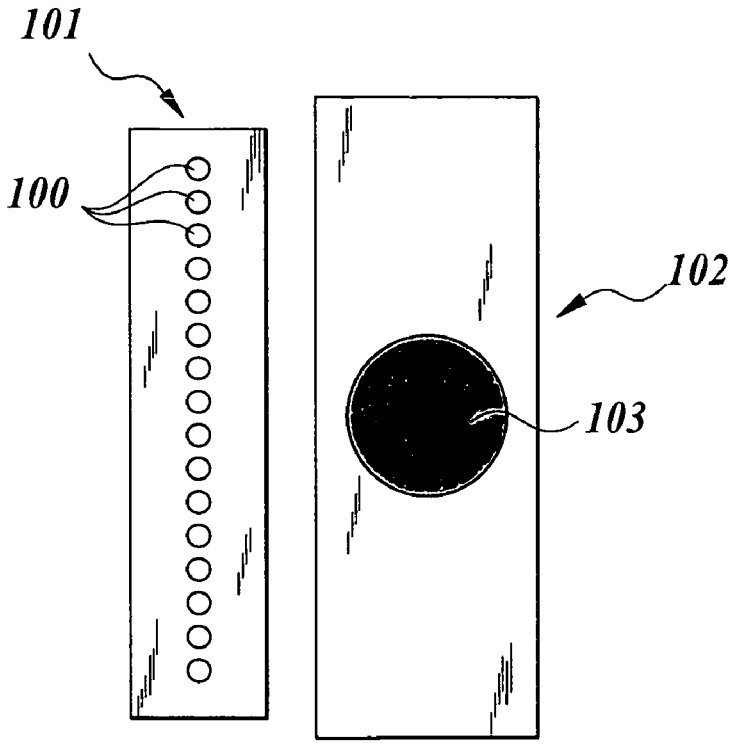
FIG. 7 is a bottom view of a recording head and an irradiation section in the earlier developed ink jet recording apparatus.

In the above described first to third embodiments, the irradiation elements 1210, 3210 were explained as a semiconductor laser, however, it is not limited thereto if it can radiate light. A solid-state laser, a gas laser, a liquid laser, a free electron laser, an X-ray laser, a fluorescent tube, a light emitting diode (LED) and an electron beam irradiation device may be also used. As shown in FIG. 6, the irradiation element may be one end H1 of the optical cable H, another end (not shown) of which being connected to a light source (not shown). In this case, the irradiation element can be a simple structure, so that a plurality of the irradiation elements can be easily disposed in line in comparison with disposing a light source such as a semiconductor laser in line. The light source which is connected to the optical cable H is provided outside of the irradiation section, so that the irradiation section can be lightweight in comparison with providing the light source inside of the irradiation section. Further, since the irradiation section can be lightweight as described above, a member for supporting the irradiation section can be simplified. Accordingly, the ink jet printer can be made at low cost.

The lenses 1212, 1212 were explained to make the light radiated from the irradiation element 1210 be approximately parallel pencil, however, it is not limited thereto. It may be convergent light which converges toward the recording medium K from the irradiation element 1210 or a diffuse light which diffuses.

Only one irradiation section 121 was explained to be provided, however, it may be provided on both sides of the recording head 120 in the scanning direction Y. Therefore, since the ink jetted on the recording medium K can be immediately irradiated with light even when the carriage moves any one of the directions in the scanning direction Y, the ink can be prevented from blotting on the surface of the recording medium K. Thus, since an image can certainly be recorded even when the carriage moves any one of the directions in the scanning direction Y, the recording can be carried out at high speed in comparison with the case of recording an image only when the carriage moves in one direction of the scanning direction Y.

The recording heads 120, 220, 320 were explained as a serial type, however, it may be a line type. Specifically, the plurality of ink jet openings are arranged in a width direction (arrangement direction) of the recording medium K, enabling the recording head to jet ink from one end to the other end in the width direction of the recording medium K. A plurality of the irradiation elements are disposed in the width direction of the recording medium K, and the irradiation section is disposed on the downstream side of the recording head in the carrying direction X. Therefore, the recording can be carried out at high speed in comparison with the case of the serial type recording head.

Further, it is explained that the three recording heads 220, . . . jet any one of the inks of yellow, magenta and cyan, however, it is not limited thereto. Other colors such as black or the like may be used.

In the above described first and second embodiment, it is explained that the lenses 1212, 1212 of the irradiation section 121 are for equalizing the size of the irradiated portion on the recording medium K with the size of the ink dot, however, a diameter in the irradiated portion on the recording medium K in the carrying direction X may be equal to the ink dot diameter, and a diameter in the irradiated portion on the recording medium K in the scanning direction Y may be larger than the ink dot diameter. In this case, since the irradiation time to the ink on the recording medium K when scanning the carriage can be longer, the ink on the recording medium K can certainly be cured.

In the above described second embodiment, it is explained that three recording heads 220 are provided, however, two or more than three recording heads may be provided.

In the above described third embodiment, it is explained that the lens 1212 is for equalizing the size of the irradiated portion on the recording medium K with the size of the ink jetted region of the ink jetted from the jet opening group gn, however, a diameter in the irradiated portion in the carrying direction X may be equal to the size of the ink jetted region of the ink jetted from the jet opening group gn in the carrying direction X.

The entire disclosure of Japanese Patent Application No. Tokugan 2002-337040 which was filed on Nov. 20, 2002, including specification, claims, drawings and summary are incorporated herein by reference in its entirety.

What is claimed is:

1. An ink jet recording apparatus comprising:

a serial type recording head which has a plurality of ink jet openings for jetting photo-curable ink toward a recording medium, the ink jet openings being arranged in one or more lines; and an irradiation section which is provided adjacent to the recording head in a scanning direction of the recording head, for irradiating an ink jetted on the recording medium with light, the irradiation section having a plurality of irradiation elements which correspond to the ink jet openings, respectively, and which are arranged in one or more lines in approximately parallel with an arrangement direction of the plurality of ink jet openings, and an irradiation controller for controlling the irradiation elements to light at least an irradiation element which corresponds to an ink jet opening which jetted the ink, and not to light an irradiation element which corresponds to an ink jet opening which did not jet the ink, in the plurality of irradiation elements.

2. The ink jet recording apparatus of claim 1, further comprising an ink jet controller for controlling an amount of the ink jetted from the ink jet opening, the irradiation controller changing an amount of irradiating light to the recording medium from the irradiation element which corresponds to the ink jet opening, depending upon an amount of the ink jetted by the ink jet opening.

3. The ink jet recording apparatus of claim 1, wherein the irradiation element is provided as many as the ink jet opening.

4. The ink jet recording apparatus of claim 1, wherein the number of the irradiation elements is less than the number of the ink jet openings, an irradiation element is provided corresponding to an ink jet opening group which comprises at least an ink jet opening, and the irradiation controller changes an amount of irradiating light to the recording medium from the irradiation element which corresponds to the ink jet opening group, depending upon an amount of the ink jetted from the ink jet opening group.

5. The ink jet recording apparatus of claim 4, wherein the irradiation section further comprises a lens for approximately equalizing a size of an irradiated portion of the recording medium with a size of an ink jetted region of the ink jetted from the jet opening group by refracting light radiated from the irradiation element.

6. The ink jet recording apparatus of claim 4, wherein the irradiation section further comprises a lens for approximately equalizing a diameter of an irradiated portion of the recording medium in the arrangement direction with a size of an ink jetted region of the ink jetted from the jet opening group in the arrangement direction, by refracting light radiated from the irradiation element.

7. The ink jet recording apparatus of claim 1, wherein the irradiation element comprises one end of an optical cable, another end of which being connected to a light source.

8. The ink jet recording apparatus of claim 1, wherein the irradiation element irradiates the ink jetted on the recording medium with light as an approximately parallel pencil.

9. The ink jet recording apparatus of claim 1, wherein the irradiation element irradiates the ink jetted on the recording medium with light as one of a convergent light or a diffuse light.

10. The ink jet recording apparatus of claim 1, wherein the irradiation section further comprises a lens for approximately equalizing a size of an irradiated portion of the recording medium with a size of a dot formed by the ink on the recording medium, by refracting light radiated from the irradiation element.

11. The ink jet recording apparatus of claim 1, wherein the irradiation section further comprises a lens for approximately equalizing a diameter of an irradiated portion of the recording medium in the arrangement direction with a dot diameter formed by the ink on the recording medium by refracting light radiated from the irradiation element.

12. The ink jet recording apparatus of claim 1, wherein a plurality of recording heads are provided.

13. The ink jet recording apparatus of claim 1, wherein an image is recorded on the recording medium.

14. The ink jet recording apparatus of claim 1, wherein the irradiation element is at least any one of a solid-state laser, a gas laser, a liquid laser, a free electron laser, an X-ray laser, a fluorescent tube, a light emitting diode and an electron beam irradiation device.

15. The ink jet recording apparatus of claim 1, wherein the ink jet opening jets an ultraviolet curable ink, and the irradiation element radiates an ultraviolet-ray.

16. The ink jet recording apparatus of claim 15, wherein the ink jet opening jets a cationic polymerization ink.

17. An ink jet recording apparatus comprising:

a line type recording head which has a plurality of ink jet openings for jetting photo-curable ink toward a recording medium, the ink jet openings being arranged in one or more lines; and an irradiation section which is provided adjacent to the recording head in a carrying direction of the recording medium, for irradiating an ink jetted on the recording medium with light, the irradiation section having a plurality of irradiation elements which correspond to the ink jet openings, respectively, and which are arranged in one or more lines in approximately parallel with an arrangement direction of the plurality of ink jet openings, and an irradiation controller for controlling the irradiation elements to light at least an irradiation element which corresponds to an ink jet opening which jetted the ink, and not to light an irradiation element which corresponds to an ink jet opening which did not jet the ink, in the plurality of irradiation elements.

18. The ink jet recording apparatus of claim 17, further comprising an ink jet controller for controlling an amount of the ink jetted from the ink jet opening, the irradiation controller changing an amount of irradiating light to the recording medium from the irradiation element which corresponds to the ink jet opening, depending upon an amount of the ink jetted by the ink jet opening.

19. The ink jet recording apparatus of claim 17, wherein the irradiation element is provided as many as the ink jet opening.

20. The ink jet recording apparatus of claim 17, wherein the number of the irradiation elements is less than the number of the ink jet openings, an irradiation element is provided corresponding to an ink jet opening group which comprises at least an ink jet opening, and the irradiation controller changes an amount of irradiating light to the recording medium from the irradiation element which corresponds to the ink jet opening group, depending upon an amount of the ink jetted from the ink jet opening group.

21. The ink jet recording apparatus of claim 20, wherein the irradiation section further comprises a lens for approximately equalizing a size of an irradiated portion of the recording medium with a size of an ink jetted region of the ink jetted from the jet opening group by refracting light radiated from the irradiation element.

22. The ink jet recording apparatus of claim 20, wherein the irradiation section further comprises a lens for approximately equalizing a diameter of an irradiated portion of the recording medium in the arrangement direction with a size of an ink jetted region of the ink jetted from the jet opening group in the arrangement direction, by refracting light radiated from the irradiation element.

23. The ink jet recording apparatus of claim 17, wherein the irradiation element comprises one end of an optical cable, another end of which being connected to a light source.

24. The ink jet recording apparatus of claim 17, wherein the irradiation element irradiates the ink jetted on the recording medium with light as an approximately parallel pencil.

25. The ink jet recording apparatus of claim 17, wherein the irradiation element irradiates the ink jetted on the recording medium with light as one of a convergent light or a diffuse light.

26. The ink jet recording apparatus of claim 17, wherein the irradiation section further comprises a lens for approximately equalizing a size of an irradiated portion of the recording medium with a size of a dot formed by the ink on the recording medium, by refracting light radiated from the irradiation element.

27. The ink jet recording apparatus of claim 17, wherein the irradiation section further comprises a lens for approximately equalizing a diameter of an irradiated portion of the recording medium in the arrangement direction with a dot diameter formed by the ink on the recording medium by refracting light radiated from the irradiation element.

28. The ink jet recording apparatus of claim 17, wherein a plurality of recording heads are provided.

29. The ink jet recording apparatus of claim 17, wherein an image is recorded on the recording medium.

30. The ink jet recording apparatus of claim 17, wherein the irradiation element is at least any one of a solid-state laser, a gas laser, a liquid laser, a free electron laser, an X-ray laser, a fluorescent tube, a light emitting diode and an electron beam irradiation device.

31. The ink jet recording apparatus of claim 17, wherein the ink jet opening jets an ultraviolet curable ink, and the irradiation element radiates an ultraviolet-ray.

32. The ink jet recording apparatus of claim 31, wherein the ink jet opening jets a cationic polymerization ink.

* * * * *